US011485032B2

(12) United States Patent
Chan

(10) Patent No.: US 11,485,032 B2
(45) Date of Patent: Nov. 1, 2022

(54) HAIR-CUTTING SHEARS

(71) Applicant: Nelson Chan, Hong Kong (CN)

(72) Inventor: Nelson Chan, Hong Kong (CN)

( * ) Notice: Subject to any disclaimer, the term of this patent is extended or adjusted under 35 U.S.C. 154(b) by 0 days.

(21) Appl. No.: 17/055,203

(22) PCT Filed: May 15, 2019

(86) PCT No.: PCT/CN2019/087033

§ 371 (c)(1),
(2) Date: Nov. 13, 2020

(87) PCT Pub. No.: WO2019/219025

PCT Pub. Date: Nov. 21, 2019

(65) Prior Publication Data

US 2021/0114240 A1 Apr. 22, 2021

(30) Foreign Application Priority Data

May 17, 2018 (CN) ..... 201820732495.0

(51) Int. Cl.

| | |
|---|---|
| ***B26B 13/00*** | (2006.01) |
| ***B26B 13/06*** | (2006.01) |
| ***B26B 13/24*** | (2006.01) |

(52) U.S. Cl.

CPC ..... *B26B 13/06* (2013.01); *B26B 13/24* (2013.01)

(58) Field of Classification Search

CPC ..... B26B 13/00; B26B 13/06; B26B 13/24
See application file for complete search history.

(56) References Cited

U.S. PATENT DOCUMENTS

| | | | | |
|---|---|---|---|---|
| 254,735 | A * | 3/1882 | Hoesen | B26B 13/06 30/254 |
| 3,304,606 | A * | 2/1967 | O'Connell | B26B 13/08 30/193 |
| 4,660,285 | A * | 4/1987 | Pracht | B26B 13/08 30/195 |
| 6,105,256 | A * | 8/2000 | Budrow | B26B 17/00 30/176 |
| 6,260,279 | B1 * | 7/2001 | Apolinski | B26B 17/00 30/125 |
| 6,314,647 | B1 * | 11/2001 | Coxsey | A01G 3/0255 30/134 |
| 2010/0192384 | A1 * | 8/2010 | Fox | B26B 13/20 30/232 |

* cited by examiner

*Primary Examiner* — Stephen Choi
(74) *Attorney, Agent, or Firm* — Houtteman Law LLC

(57) ABSTRACT

Hair-cutting shears, comprising a first grip handle (100) and a second grip handle (200) that are hinged to each other, and further comprising a sharp edge (10) and a support table (20), the sharp edge being disposed at the other end of the second grip handle. The support table is disposed at the other end of the first grip handle, the support table is provided thereon with a cutter table (23) made of a gum material; and when abutting, the sharp edge and the support table are side by side and abut on the cutter table.

5 Claims, 3 Drawing Sheets

HAIR-CUTTING SHEARS

TECHNICAL FIELD

The invention relates to a hair dressing tool, in particular to a hair-cutting shear.

BACKGROUND ART

The hair clipper is a necessary tool to cut hair and build different types of hair styles by trimming the length and layers of hair. The traditional hair clippers are divided into scissors and shavers. When the hair is sheared, the following problems can be caused.

(1) The structure of the scissors includes two sharp edges which are used for cutting as the edges at the two sides are simultaneously squeezed, so that a fracture surface layer is formed with a fracture towards the middle into a convex tip due to the pressure from the two sides; and the hair close to a hinged position of the sharp edges are firstly cut, and the hair far away from the hinged position of the sharp edges are inevitably cut afterwards, so that the trend of the hair line direction cannot be fully controlled to affect the hairstyle.

(2) When a traditional razor (or a shaver) is used for cutting off hair, the hair is tensioned by hand, and then the hair is cut off by dropping the razor at a straightened position. However, the broken surface of a hair tail has a too large bevel to generate scraps, and the hair is damaged. The traditional razor needs to apply a force by pulling the tail of the hair by hand, and then scrape the hair downwards by force to cut off the hair. If the hair is too short and the hair cannot be pulled by hand without an application point, the purpose of cutting off the hair cannot be achieved.

Therefore, whether scissors or a shaver is used, trimmed hair tips are irregular, affecting the health of the hair and also the building of the hair style.

In view of this, there is an urgent need to improve the structure of the conventional hair clipper for convenient operation so as not to damage the hair and so as to more easily control the trend of the hair.

SUMMARY OF THE INVENTION

The technical problem to be solved by the utility model is that the existing hair clipper has the problems of damaging the hair and not easily controlling the trend of the hair. In order to solve the technical problem, the technical solution adopted by the utility model is to provide a hair-cutting shear comprising a first grip handle and a second grip handle, further comprising:

a sharp edge disposed at the other end of the second grip handle; and a support table disposed at the other end of the first grip handle, wherein the support table is provided thereon with a cutter table made of a gum material; and when abutting, the sharp edge and the support table are side by side and abut on the cutter table.

In another preferred embodiment, an end away from the sharp edge and adjacent to a hinged position where the first grip handle and the second grip handle are hinged to each other is provided with a pressing position for facilitating the application of a force by a thumb, and opposite surfaces of the sharp edge and the support table adjacent to the hinged position are each provided with a concave arc groove.

In another preferred embodiment, the sharp edge comprises a blade sheath, a blade wrapping layer and a blade which are sequentially nested, the support table comprises a cutter table sheath and a cutter table wrapping layer disposed in the cutter table sheath, and the cutter table is embedded in the cutter table wrapping layer.

In another preferred embodiment, the side wall of the blade sheath is provided with a convex protruding inwards, the cutter table wrapping layer is provided with a recess matched with the convex, and the blade wrapping layer together with the blade slides into the blade sheath and is clamped and fixed by the convex and the recess.

In another preferred embodiment, the blade sheath and the blade wrapping layer are both iron, and the cutter table sheath and the cutter table wrapping layer are also iron. In another preferred embodiment, the cross section of the cutter table is T-shaped. In another preferred embodiment, a tooth-shaped protrusion is provided on the cutter table.

In another preferred embodiment, each of the first grip handle and the second grip handle is provided with a finger ring for facilitating application of force.

In another preferred embodiment, the finger ring on the first grip handle is rotationally disposed, a tail end of the first grip handle is provided with an arc-shaped gripping position, and the finger ring on the second grip handle is integrally formed.

In another preferred embodiment, an outer end of the finger ring on the second grip handle is provided with an arc-shaped ejector rod.

In another preferred embodiment, the finger rings convenient for applying force are provided on both grip handles.

Compared with the prior art, when in use and operation of the utility model, the sharp edge and the support table are scissor-shaped when opened, and occlude together as a flat-strip when closed, and the sharp blade abuts on the cutter table made of the gum material. Hair may be pressed and cut like chopping a vegetable, and the cut hair is broken into a unidirectional bevel incision. Without being limited for operation by the length of the hair, the hair may be controlled to produce a three-dimensional effect of different angles, and will not cause damage to the hair. The present invention is convenient to use and has a better shape-forming effect.

DETAILED DESCRIPTION OF THE INVENTION

The utility model provides a hair-cutting shear. The hair can be cut when the hair is pulled by application of slight force and a sharp edge is pressed downwards; and the operation is convenient, and the hair is not damaged. The present utility model will be described in detail with reference to the drawings and detailed description.

Figure 1:
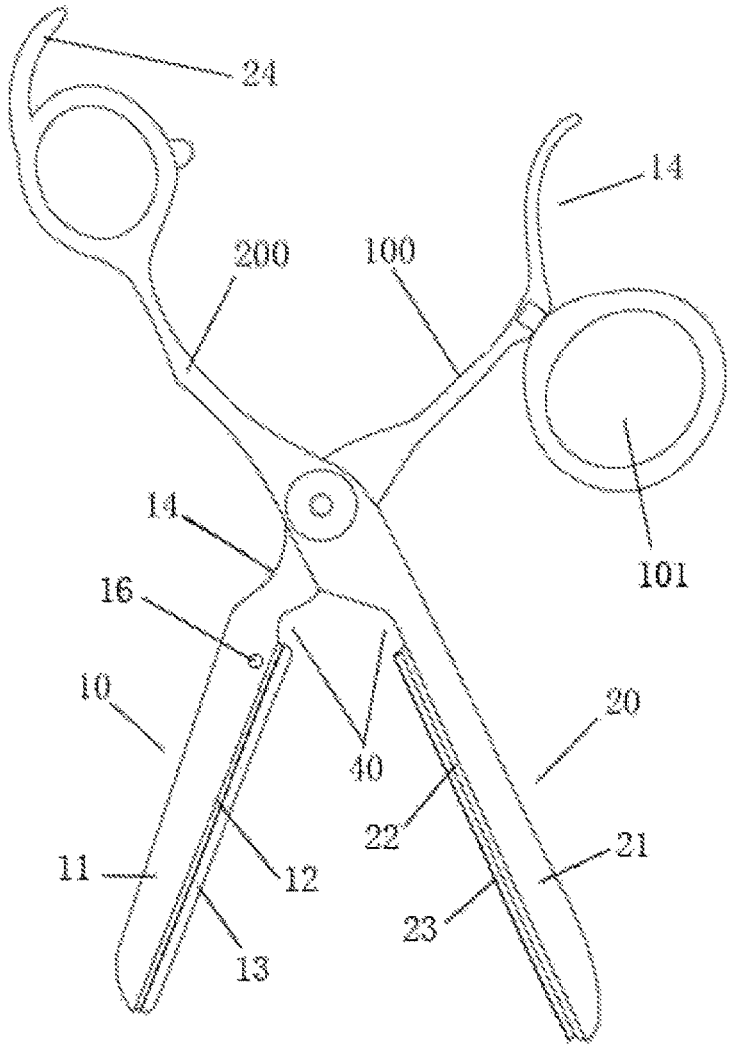
FIG. 1 is a perspective view of the utility model after being opened.
Figure 2:
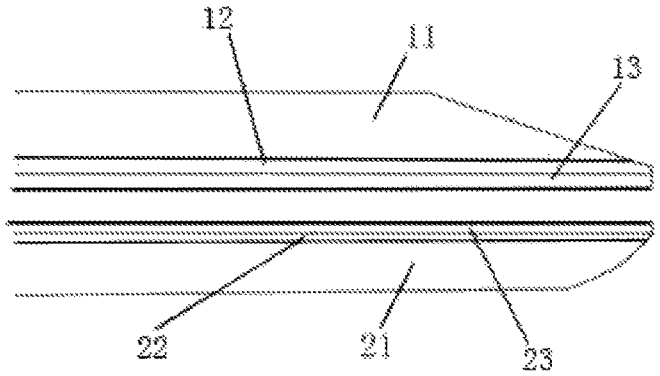
FIG. 2 is a perspective view of the utility model after being folded.

As shown in FIGS. 1 and 2, the utility model provides a hair-cutting shear comprising a first grip handle 100 and a second grip handle 200 that are hinged to each other, and further comprising a sharp edge 10 and a support table 20, wherein the sharp edge 10 is disposed at the other end of the first grip handle 100, the support table 20 is disposed at the other end of the second grip handle 200, and the support table 20 is provided thereon with a cutter table 23 made of a gum material; and when abutting, the sharp edge 10 and the support table 20 are side by side and abut on the cutter table 23. The gum material is hard, but has certain toughness at the same time, and can be slightly deformed only by a sharp object such as a blade, so that the blade can be protected while the hair can be quickly cut off, the cost is low, the overall weight of the cutting shear is reduced, and it is convenient to use.

According to the utility model, only one sharp edge 10 is arranged, the support table 20 is provided with a cutter table 23 which only serves as a stress point for supporting the sharp edge 10. When light force is applied to pull the hair, the sharp edge 10 is pressed downwards, and can be slightly deformed by the gum material, and the hair can be cut. The pulling force to the hair can be controlled to enable the hair to be generate fractures with different angles and inclined unidirectional bevels during breakage of the hair, so that each of the hair can be guided to have a fracture with different inclined surfaces independently, the inclined surfaces of the whole hair piece can be controlled freely, and the continuous incision inclined surfaces from small to large can be made. Therefore, the hair can be controlled to generate a three-dimensional effect of guiding different angles, and a hairstylist can use technical adjustment to play the best hair cutting effect. In addition, when the sharp edge 10 and the support table 20 are closed during operation, the support table 20 becomes a force application point for the sharp edge 10, so that the hair bundle does not need to be tensioned by hands for application of force. The long and short hair can be cut off, the operation is convenient, the labor is saved, and the hair with different lengths can be trimmed.

When the cutting application breaks the hair, the hair follicle at a root part is stimulated due to the root part of each hair subjected to the pulling force, so that blood circulation is generated, and metabolism is accelerated. The hair grows rapidly and is vigorous and healthier, which is more suitable for the health concept of modern people.

Preferably, the outer side of the sharp edge 10 adjacent to the hinged position is provided with a pressing position 14 for facilitating the application of a force by a thumb, and the pressing position 14 helps an operator to control the magnitude of the force according to the amount of the hair. The pressing position 14 may be provided as a groove shape, or an anti-slip pattern may be added to improve the convenience of use. The inner sides of the sharp edge 10 and the support table 20 adjacent to the hinged position are each provided with a concave arc groove 40. Since the sharp edge 10 and the support table 20 are formed side by side when being closed, the sharp edge 10 and the support table 20 are inclined toward each other, so that the circular groove 40 prevents excessive friction between the sharp edge 10 and the support table 20, thereby improving the convenience of opening and closing.

Figure 3:
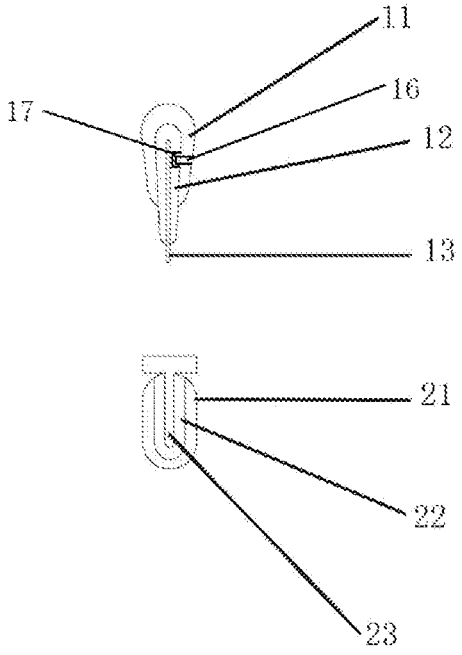
FIG. 3 is a side view of a sharp edge and a support table of FIG. 2.

Preferably, as shown in FIGS. 2 and 3, the sharp edge 10 includes a blade sheath 11, a blade wrapping layer 12 and a blade 13 which are sequentially nested, the support table 20 includes a cutter table sheath 21 and a cutter table wrapping layer 22 disposed in the cutter table sheath 21, and the cutter table 23 is embedded in the cutter table wrapping layer 22. The blade sheath 11 and the cutter table sheath 21 can protect the internal blade 13 and the cutter table 23, and prevent collision and abrasion of the blade 13 and the cutter table 23.

Figure 5:
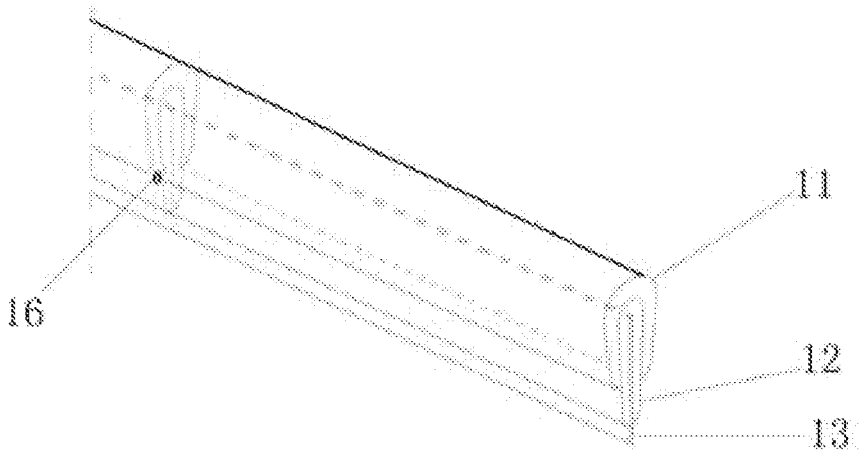
FIG. 5 is a structurally schematic view of the sharp edge of the utility model.

Preferably, as seen in FIG. 5, the side wall of the blade sheath 11 is provided with a convex 16 protruding inwards, the blade wrapping layer 12 is provided with a recess 17 matched with the convex 16, the blade wrapping layer 12 together with the blade 13 slides into the blade sheath 11 and is clamped and fixed by the convex 16 and the recess 17. When a replacement is required, the blade wrapping layer 12 together with the blade 13 is taken out and replaced integrally. The blade sheath 11 and the blade wrapping layer 12 are made of iron, so that the tightness of connection is guaranteed. Furthermore, the clamping connection of the recess 17 and the convex 16 can firmly grasp the blade 13 and prevent the blade 13 from falling off.

The blade sheath 11 and the blade wrapping layer 12 are both iron, and the cutter table sheath 21 and the cutter table wrapping layer 22 are also iron can also adopt stainless steel materials. The metal materials have the advantages of being difficult to deform and high in strength, which can guarantee accurate shearing action of the blade 13 and the cutter table 23 in the using process, and improves the using flexibility. The blade wrapping layer 12 closely mates with the blade 13 to facilitate the overall installation and removal of the blade 13.

Figure 4:
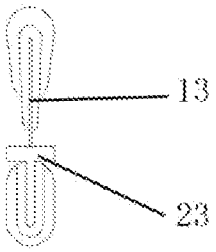
FIG. 4 is a side view of the sharp edge and the support table of FIG. 2 after being connected.

Preferably, as shown in FIG. 4, the cross-section of the cutter table 23 is T-shaped, which ensures that the cutter table 23 has a flat sheared surface and that the hair is stressed perpendicularly to the sheared surface, so that the cut surface is perpendicular to the hair.

Figure 6:
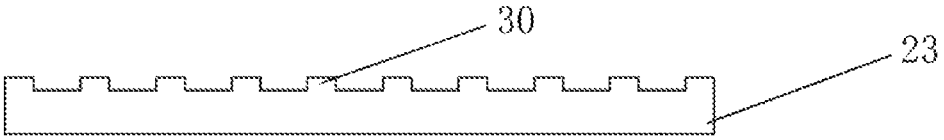
FIG. 6 is a structurally schematic view of another embodiment of a cutter table of the present utility model.

Preferably, as shown in FIG. 6, the support table 20 is provided with the tooth-shaped protrusions 30, so that a thinning effect can be achieved. The gap between the tooth-shaped protrusions 30 is designed to be reserved for hair which does not need to be removed. The hair pieces are arranged on the support table 20, and the hair is stressed and cut off, so that each hair has a unidirectional guiding effect while each hair piece to be cut is thinned.

Preferably, each of the first grip handle 100 and the second grip handle 200 is provided with a finger ring 101 convenient for applying force. In FIG. 1, each grip handle is provided with one finger ring 101, and the two finger rings 101 respectively correspond to the positions of the thumb and the index finger of a human hand. Alternatively, the first grip handle 100 may be provided with two finger rings 101 respectively corresponding to the positions of the index finger and the middle finger. The structure of the finger ring 101 is more convenient for operation, and it is not easy to cause a fault to the cutting and shearing when the finger ring 101 is used. In the embodiment, the finger ring 101 on the first grip handle 100 is rotationally disposed. The rotation arrangement is convenient for a human hand to automatically rotate according to the posture and the force in the using process, and the use is smoother. The tail end of the first grip handle 100 is provided with an arc-shaped gripping position 14 which facilitates gripping and application of force by the ring finger. The finger ring 101 on the second grip handle 200 is integrally formed, and the finger ring 101 of the second grip handle 200 is used for thumb insertion, with the integral forming of the finger ring 101 for convenient use.

The outer end of the finger ring 101 on the second grip handle 200 is provided with an arc-shaped ejector rod 24. When the thumb is not inserted into the finger ring 101 for use, the finger ring 101 is generally held in the palm of the hand, and at the moment, the ejector rod 24 can be pushed against the inner side of the palm of the hand, so that it is convenient to integrally position and also practical. The ejector rod 24 is arc-shaped, and an anti-slip layer can be added, with smooth lines and better sense of use.

The utility model is not limited to the above-mentioned preferred embodiment. Anyone should know structural changes made under the inspiration of the utility model. All technical solutions which are the same as or similar to those of the utility model fall within the scope of protection of the utility model.

The invention claimed is:

1. A hair-cutting shear, comprising a first grip handle and a second grip handle that are hinged to each other, characterized by further comprising:

a sharp edge disposed at the other end of the second grip handle and being a portion thereof; and a support table disposed at the other end of the first grip handle and being a portion thereof, wherein the support table is provided thereon with a cutter table made of a gum material; and when abutting, the sharp edge and the support table are side by side and abut on the cutter table, the sharp edge and the support table are inclined toward each other;

the sharp edge comprises a blade sheath, a blade wrapping layer and a blade which are sequentially nested, the support table comprises a cutter table sheath and a cutter table wrapping layer disposed in the cutter table sheath, and the cutter table is embedded in the cutter table wrapping layer;

the side wall of the blade sheath is provided with a convex protruding inwards, the blade wrapping layer is provided with a recess matched with the convex, and the blade wrapping layer together with the blade slides into the blade sheath and is clamped and fixed by the convex and the recess;

a tooth-shaped protrusion is provided on the cutter table, wherein the tooth-shaped protrusions are arranged at intervals along the length direction of the cutter table;

the finger ring on the first grip handle is rotationally disposed, a tail end of the first grip handle is provided with an arc-shaped gripping position, and the finger ring on the second grip handle is integrally formed;

an outer end of the finger ring on the second grip handle is provided with an arc-shaped ejector rod.

2. The hair-cutting shear according to claim 1, wherein an end of the second grip, away from the sharp edge and adjacent to a hinged position where the first grip handle and the second grip handle are hinged to each other is provided with a pressing position for facilitating the application of a force by a thumb, and opposite surfaces of the sharp edge and the support table adjacent to the hinged position are each provided with a concave arc groove.

3. The hair-cutting shear according to claim 1, wherein the blade sheath and the blade wrapping layer are both iron, and the cutter table sheath and the cutter table wrapping layer are also iron.

4. The hair-cutting shear according to claim 1, wherein the cross section of the cutter table is T-shaped.

5. The hair-cutting shear according to claim 1, wherein each of the first grip handle and the second grip handle is provided with a finger ring for facilitating application of force.

* * * * *